US006464518B1

(12) United States Patent
Wang

(10) Patent No.: US 6,464,518 B1
(45) Date of Patent: Oct. 15, 2002

(54) SOCKET WITH A COVER MEMBER

(75) Inventor: Robert Wang, Taipei (TW)

(73) Assignee: Ceramate Technical Co., Ltd., Tao-Yuan Hsien (TW)

( * ) Notice: Subject to any disclaimer, the term of this patent is extended or adjusted under 35 U.S.C. 154(b) by 0 days.

(21) Appl. No.: 10/011,911

(22) Filed: Nov. 5, 2001

(51) Int. Cl.[7] ..... H01R 13/44
(52) U.S. Cl. ..... 439/142
(58) Field of Search ..... 439/142, 135, 439/136, 148, 149, 373, 144, 677, 680

(56) References Cited

U.S. PATENT DOCUMENTS 2,878,456 A * 3/1959 Cormier ..... 439/142
3,239,791 A * 3/1966 Fyrk ..... 439/144
3,436,716 A * 4/1969 Amis, Jr. et al. ..... 439/136
4,640,575 A * 2/1987 Dumas ..... 439/142
5,382,171 A * 1/1995 Hofmann et al. ..... 439/142
6,038,125 A * 3/2000 Anzai ..... 439/142

* cited by examiner

*Primary Examiner*—Gary Paumen
*Assistant Examiner*—Felix O. Figueroa
(74) *Attorney, Agent, or Firm*—Ladas & Parry

(57) ABSTRACT

A socket includes an outer housing having two parallel outer side walls, and an inner housing defining a front opening and having two parallel inner side walls, each of which has a first section that is received securely in the outer housing and that confronts a respective one of the outer side walls, and a second section that projects outwardly from the outer housing. The first section of one of the inner side walls cooperates with a respective one of the outer side walls to define a gap therebetween. A cover member has a mounting portion that is inserted into the gap, and a door portion that is turnably connected to the mounting portion so as to be turnable relative to the mounting portion between a closed position, in which, the door portion covers the front opening, and an opening position, in which, the door portion turns away from the front opening.

4 Claims, 5 Drawing Sheets

SOCKET WITH A COVER MEMBER

BACKGROUND OF THE INVENTION

1. Field of the Invention

This invention relates to a socket with a cover member for preventing dust from entering into the socket.

2. Description of the Related Art

FIGS. 1 and 2 illustrate a conventional socket 400 that is adapted to be mounted on a mounting board 1 in an electronic device (not shown), such as a DVD player or a CVD player, and that is adapted to receive a cable with a generally rectangular plug 2. The socket 400 includes an outer housing 402 and an inner housing 403 that is received securely in the outer housing 402 and that defines a receiving space 401 for receiving the plug 2. A cylindrical mounting part 302 is formed on a top end of the outer housing 402, and defines an inner threaded hole 301. The socket 400 is mounted on the mounting board 1 via screw means extending through a hole 102 in the mounting board 1 and engaging the inner threaded hole 301. A block member 5 is inserted into the receiving space 401 when the cable is disconnected from the socket 400 so as prevent dust from entering into the socket 400. However, the block member 5 tends to be easily misplaced when not in use.

SUMMARY OF THE INVENTION

Therefore, the object of the present invention is to provide a socket with a cover member that is capable of preventing dust from entering into the socket and that is capable of overcoming the aforesaid drawback.

According to the present invention, a socket comprises: an insulator outer housing defining a rectangular first receiving space and a first front opening, and having two parallel outer side walls that respectively confine two opposite sides of the first receiving space; a rectangular insulator inner housing defining a second front opening and a generally rectangular second receiving space that is adapted to receive the plug of the cable via the second front opening, and having two parallel inner side walls, each of which has a first section that is received securely in the first receiving space and that confronts a respective one of the outer side walls, and a second section that projects outwardly from the first receiving space through the first front opening, the first section of one of the inner side walls cooperating with a respective one of the outer side walls to define a gap therebetween; and an insulator cover member having a mounting portion that is securely inserted into the gap and that has a front end which is substantially flush with the second front opening, and a door portion that is turnably connected to the front end of the mounting portion so as to be turnable relative to the mounting portion between a closed position, in which, the door portion turns toward the second front opening so as to cover the second front opening, and an opening position, in which, the door portion turns away from the second front opening so as to permit insertion of the plug of the cable into the second receiving space via the second front opening.

BRIEF DESCRIPTION OF THE DRAWINGS

In drawings which illustrate an embodiment of the invention.

DETAILED DESCRIPTION OF THE PREFERRED EMBODIMENT

Figure 1:
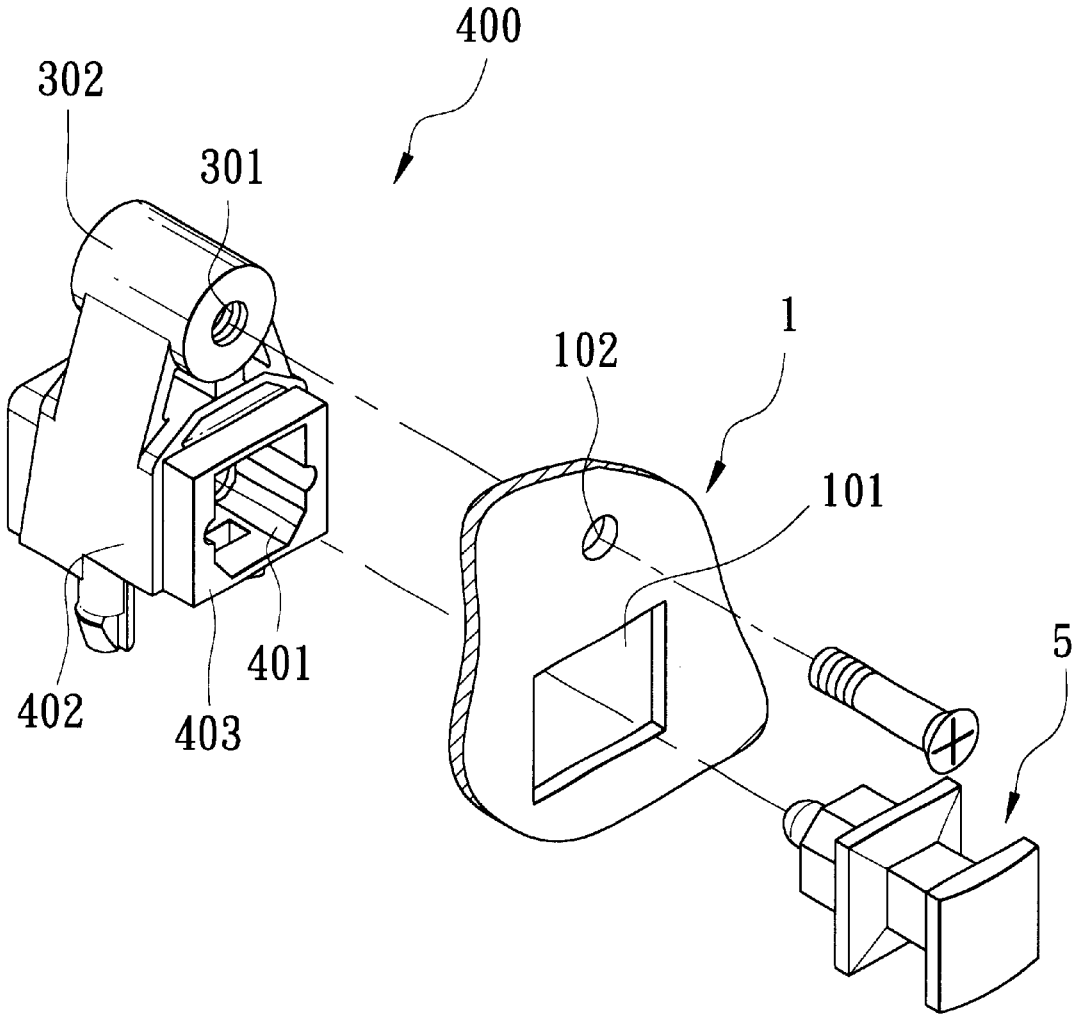
FIG. 1 PRIOR ART
FIG. 1 is an exploded perspective view showing a conventional socket.
Figure 2:
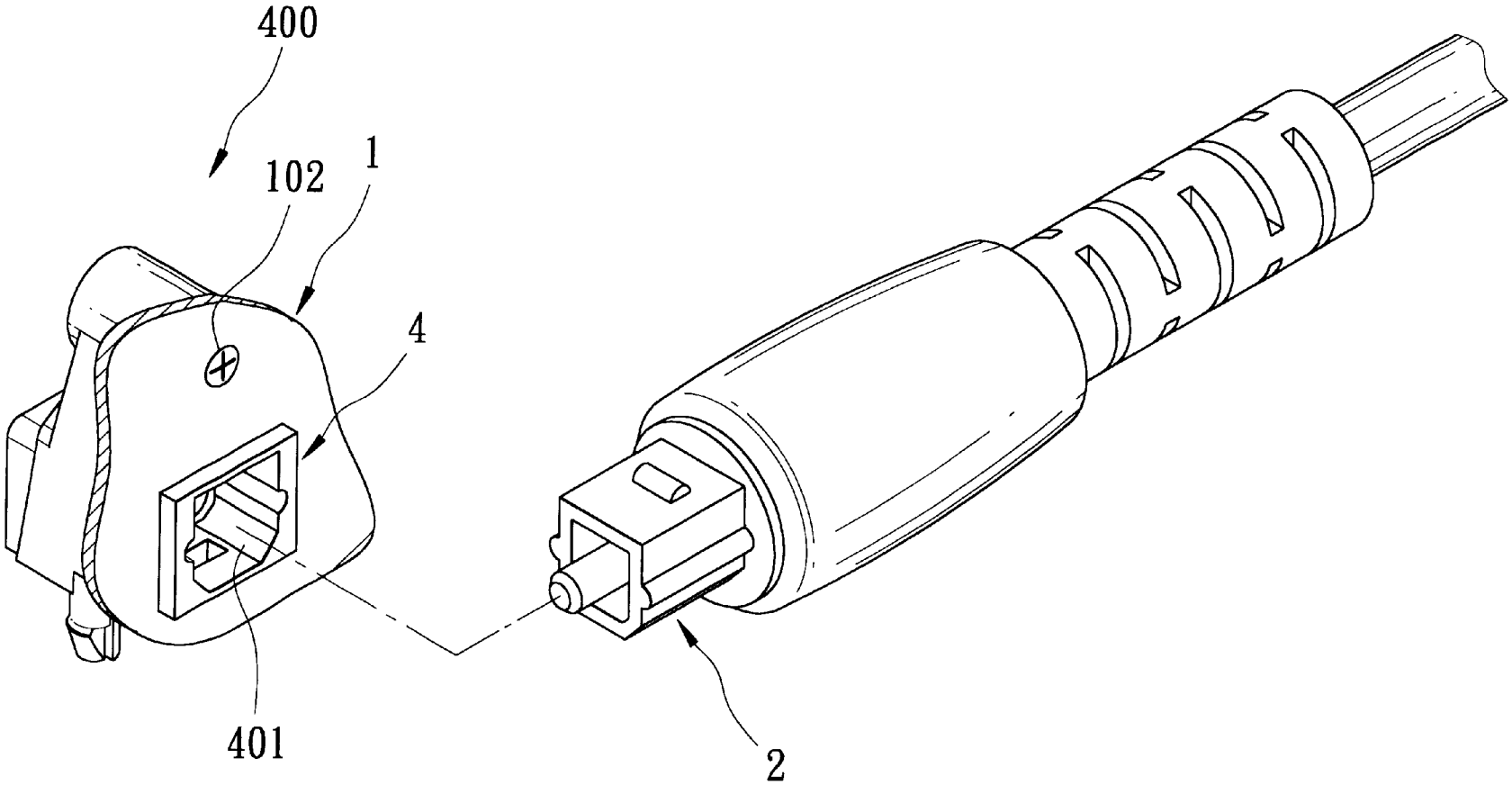
FIG. 2 PRIOR ART
FIG. 2 is a perspective view to illustrate how the socket of FIG. 1 is connected to a plug of a cable.
Figure 3:
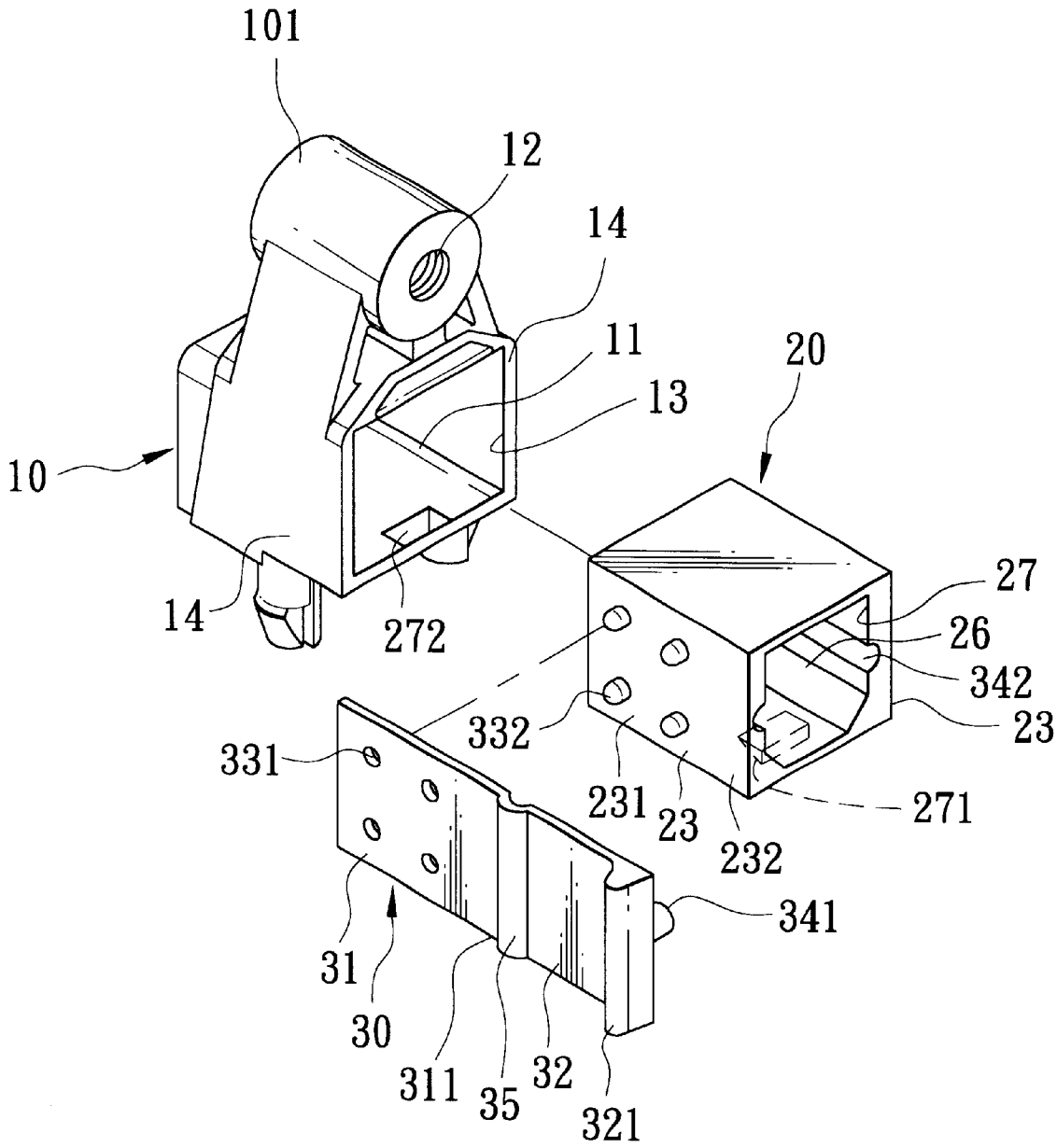
FIG. 3 is an exploded perspective view of a socket embodying this invention.
Figure 4:
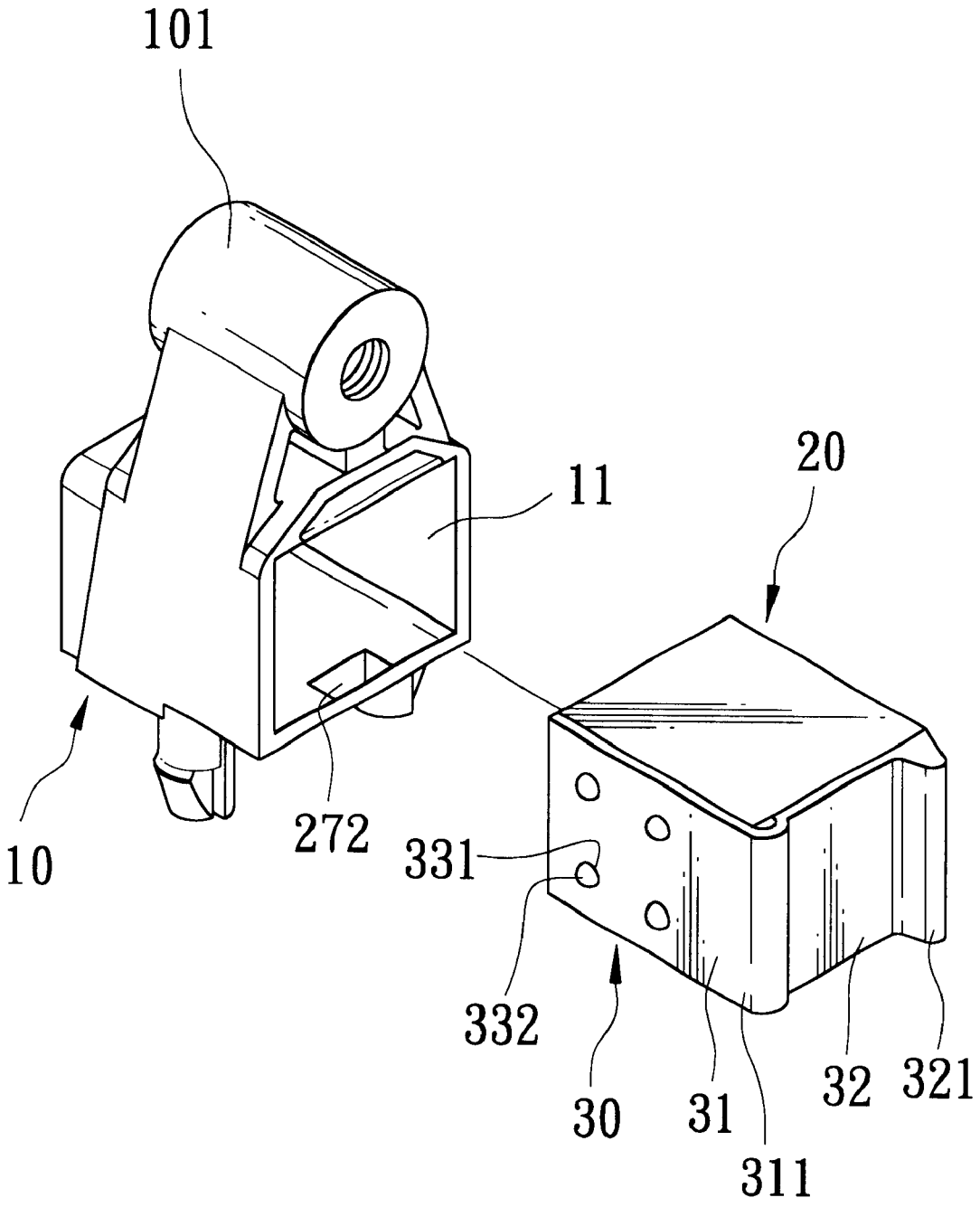
FIG. 4 is an exploded perspective view of the socket of FIG. 3 with a cover member in a closed position.
Figure 5:
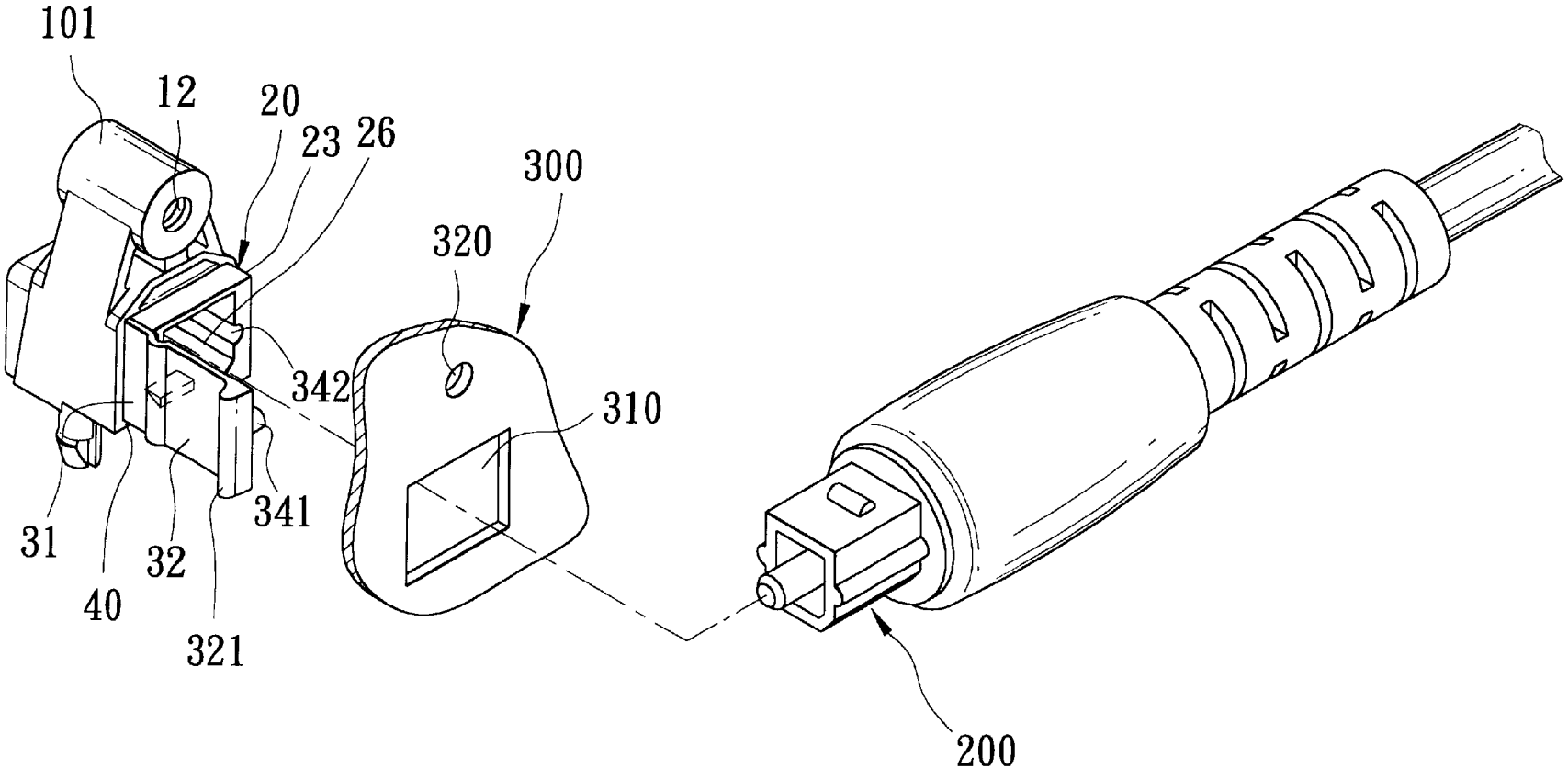
FIG. 5 is an exploded perspective view to illustrate how the socket of FIG. 3 is to be mounted on a mounting board for receiving a plug of a cable.

FIGS. 3 and 5 illustrate a socket that embodies this invention and that is adapted to be mounted on a mounting board 300 in an electronic device (not shown), such as a DVD player or a CVD player, for receiving a plug 200 of a cable.

The mounting board 300 is formed with a screw hole 320 and a window 310.

The socket includes: an insulator outer housing 10 defining a rectangular first receiving space 11 and a first front opening 13, and having two parallel outer side walls 14 that respectively confine two opposite sides of the first receiving space 11; a rectangular insulator inner housing 20 defining a second front opening 27 and a generally rectangular second receiving space 26 that is adapted to receive the plug 200 of the cable via the second front opening 27, and having two parallel inner side walls 23, each of which has a first section 231 that is received securely in the first receiving space 11 and that confronts a respective one of the outer side walls 14, and a second section 232 that projects outwardly from the first receiving space 11 through the first front opening 13, the first section 231 of one of the inner side walls 23 cooperating with a respective one of the outer side walls 14 to define a gap 40 therebetween; and an insulator cover member 30 having a mounting portion 31 that is securely inserted into the gap 40 and that has a front end 311 which is substantially flush with the second front opening 27, and a door portion 32 that is turnably connected to the front end 311 of the mounting portion 31 so as to be turnable relative to the mounting portion 31 between a closed position, in which, the door portion 32 turns toward the second front opening 27 so as to cover the second front opening 27, and an opening position, in which, the door portion 32 turns away from the second front opening 27 so as to permit insertion of the plug 200 of the cable into the second receiving space 26 via the second front opening 27.

The one of the inner side walls 23 is formed with a plurality of tongues 332 that project into the gap 40. The mounting portion 31 of the cover member 30 is formed with a plurality of retaining holes 331 that respectively engage the tongues 332 so as to immobilize the mounting portion 31 in the gap 40.

The cover member 30 is preferably made from a resilient plastic material, and further has an arcuate resilient bridging portion 35 that is integrally formed with and that interconnects the mounting and door portions 31, 32 so as to permit resilient turning of the door portion 32 relative to the mounting portion 31.

The other one of the inner side walls 23 is formed with a retaining groove 342 that is in spatial communication with the second receiving space 27. The door portion 32 has a free end 321 that is opposite to the bridging portion 35 and that is provided with a protrusion 341 for engaging removably the retaining groove 342 when the door portion 32 is at the closed position so as to prevent unforced turning of the door portion 32 to the opened position. The free end 321 of the door portion 32 has an L-shaped cross-section so as to facilitate turning of the door portion 32.

A cylindrical mounting part 101 is formed on a top end of the outer housing 10, and is formed with an inner threaded hole 12. The socket is mounted on the mounting board 300 via screw means (not shown) extending through the screw hole 320 in the mounting board 300 and engaging the inner threaded hole 12. The second sections 232 of the inner side walls 23 extend through the window 310 of the mounting board 300.

A retaining recess 272 is formed in a bottom wall of the outer housing 10. An interlocking protrusion 271 is formed on a bottom wall of the inner housing 20, and is engageable with the retaining recess 272 when the inner housing 20 is received in the first receiving space 11 so as to secure the inner housing 20 to the outer housing 10.

With the design of the cover member 30, the aforesaid drawback as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A socket adapted to receive a cable with a generally rectangular plug, comprising:

an insulator outer housing defining a rectangular first receiving space and a first front opening, and having two parallel outer side walls that respectively confine two opposite sides of said first receiving space;

a rectangular insulator inner housing defining a second front opening and a generally rectangular second receiving space that is adapted to receive the plug of the cable via said second front opening, and having two parallel inner side walls, each of which has a first section that is received securely in said first receiving space and that confronts a respective one of said outer side walls, and a second section that projects outwardly from said first receiving space through said first front opening, said first section of one of said inner side walls cooperating with a respective one of said outer side walls to define a gap therebetween; and an insulator cover member having a mounting portion that is securely inserted into said gap and that has a front end which is substantially flush with said second front opening, and a door portion that is turnably connected to said front end of said mounting portion so as to be turnable relative to said mounting portion between a closed position, in which, said door portion turns toward said second front opening so as to cover said second front opening, and an opening position, in which, said door portion turns away from said second front opening so as to permit insertion of the plug of the cable into said second receiving space via said second front opening.

2. The socket of claim 1, wherein said one of said inner side walls is formed with a plurality of tongues that project into said gap, said mounting portion of said cover member being formed with a plurality of retaining holes that respectively engage said tongues so as to immobilize said mounting portion in said gap.

3. The socket of claim 1, wherein said cover member is made from a plastic material and further has an arcuate resilient bridging portion that is integrally formed with and that interconnects said mounting and door portions so as to permit resilient turning of said door portion relative to said mounting portion.

4. The socket of claim 3, wherein the other one of said inner side walls is formed with a retaining groove that is in spatial communication with said second receiving space, said door portion having a free end that is opposite to said bridging portion and that is provided with a protrusion for engaging removably said retaining groove so as to retain releasably said door portion at said closed position.

* * * * *